US010026275B1

(12) United States Patent
Riley

(10) Patent No.: US 10,026,275 B1
(45) Date of Patent: Jul. 17, 2018

(54) PRESENTATION MODERATOR ASSEMBLY

(71) Applicant: Hugh Riley, Clifton, NJ (US)

(72) Inventor: Hugh Riley, Clifton, NJ (US)

( * ) Notice: Subject to any disclaimer, the term of this patent is extended or adjusted under 35 U.S.C. 154(b) by 0 days.

(21) Appl. No.: 15/820,426

(22) Filed: Nov. 21, 2017

(51) Int. Cl.
*G08B 5/36* (2006.01)
*G08C 17/02* (2006.01)

(52) U.S. Cl.
CPC ..... *G08B 5/36* (2013.01); *G08C 17/02* (2013.01); *G08C 2201/10* (2013.01); *G08C 2201/30* (2013.01)

(58) Field of Classification Search
CPC ..... G08B 5/36; G08C 17/02
USPC ..... 340/7.5–7.57
See application file for complete search history.

(56) References Cited

U.S. PATENT DOCUMENTS

| | | | | |
|---|---|---|---|---|
| 2,932,779 | A | 4/1960 | Tancig | |
| 4,995,018 | A | 2/1991 | Edwards | |
| 5,905,694 | A | 5/1999 | Rothberg | |
| 6,326,883 | B1 | 12/2001 | Whitehard et al. | |
| D468,218 | S | 1/2003 | Greenberg et al. | |
| D524,674 | S | 7/2006 | Masters | |
| 7,379,393 | B2 | 5/2008 | Morykwas et al. | |
| 8,547,801 | B2 | 10/2013 | Zorn et al. | |
| 9,747,763 | B1 * | 8/2017 | Scordato | G08B 7/06 |
| 2005/0180584 | A1 * | 8/2005 | Chin | H04R 5/02 381/98 |
| 2008/0184122 | A1 | 7/2008 | Grant et al. | |
| 2008/0232199 | A1 | 9/2008 | Shafton | |
| 2015/0097681 | A1 * | 4/2015 | Fadell | F24F 11/30 340/628 |
| 2017/0309138 | A1 * | 10/2017 | Siminoff | G08B 3/10 |

FOREIGN PATENT DOCUMENTS

| | | |
|---|---|---|
| WO | WO20007758 | 2/2000 |

* cited by examiner

*Primary Examiner* — Allen T Cao

(57) ABSTRACT

A presentation moderator assembly for facilitating nonverbal and nonphysical communication between a moderator and a presenter includes a base unit that is positioned in view of a presenter. The base unit has a first light emitter that is selectively illuminated to communicate to the presenter that the presenter may begin speaking. The base unit has a second light emitter that is selectively illuminated to communicate to the presenter that the presenter should begin finishing speaking. The base unit has a third light emitter that is selectively illuminated to communicate to the presenter to stop speaking. A remote unit is carried by a moderator and the remote unit is in electrical communication with the base unit. The remote unit selectively turns on each of the first, second and third light emitters.

14 Claims, 5 Drawing Sheets

PRESENTATION MODERATOR ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to moderator devices and more particularly pertains to a new moderator device for facilitating nonverbal and nonphysical communication between a moderator and a presenter.

BRIEF SUMMARY OF THE INVENTION

An embodiment of the disclosure meets the needs presented above by generally comprising a base unit that is positioned in view of a presenter. The base unit has a first light emitter that is selectively illuminated to communicate to the presenter that the presenter may begin speaking. The base unit has a second light emitter that is selectively illuminated to communicate to the presenter that the presenter should begin finishing speaking. The base unit has a third light emitter that is selectively illuminated to communicate to the presenter to stop speaking. A remote unit is carried by a moderator and the remote unit is in electrical communication with the base unit. The remote unit selectively turns on each of the first, second and third light emitters.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
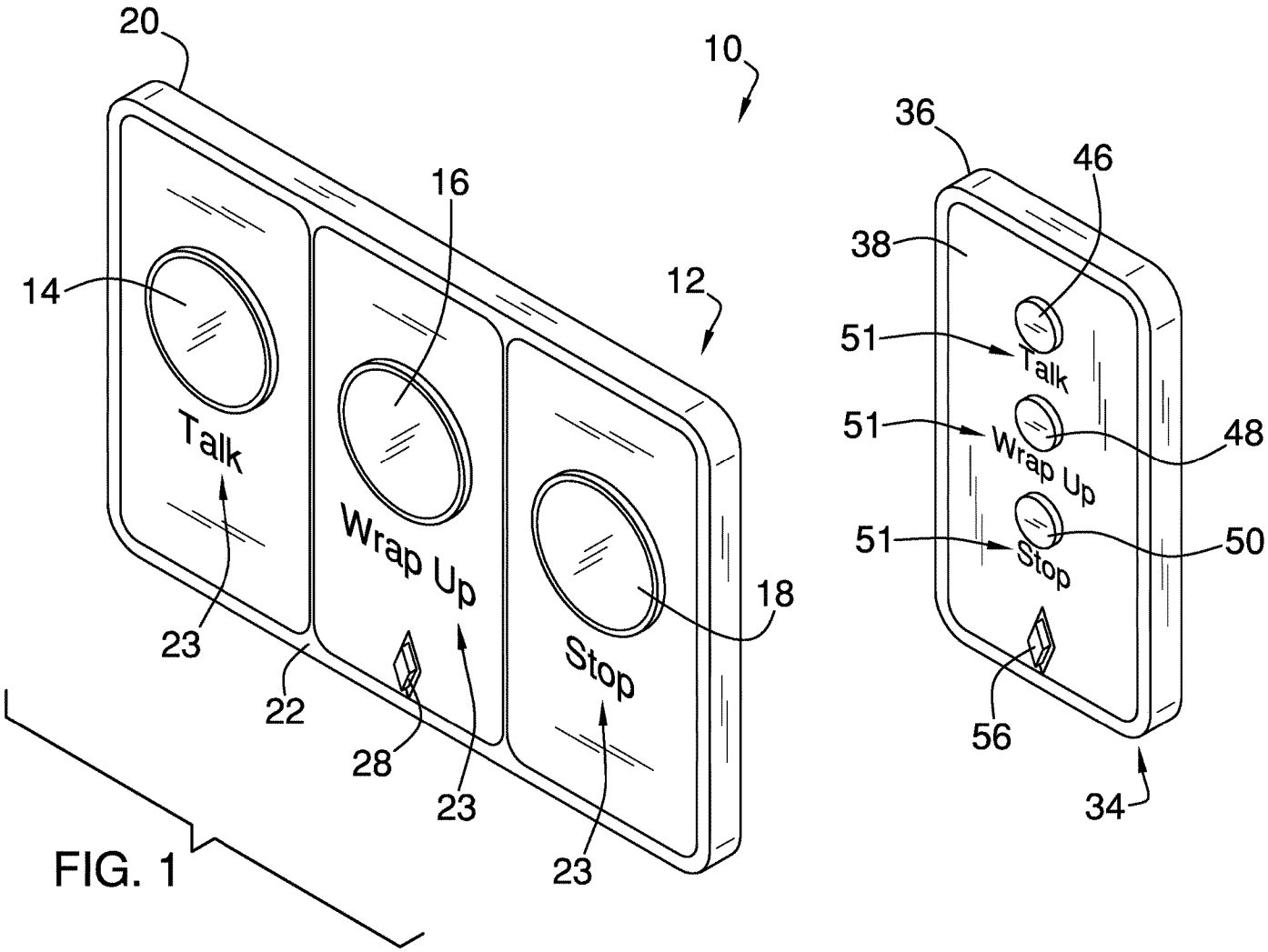
FIG. 1 is a perspective view of a presentation moderator assembly according to an embodiment of the disclosure.
Figure 2:
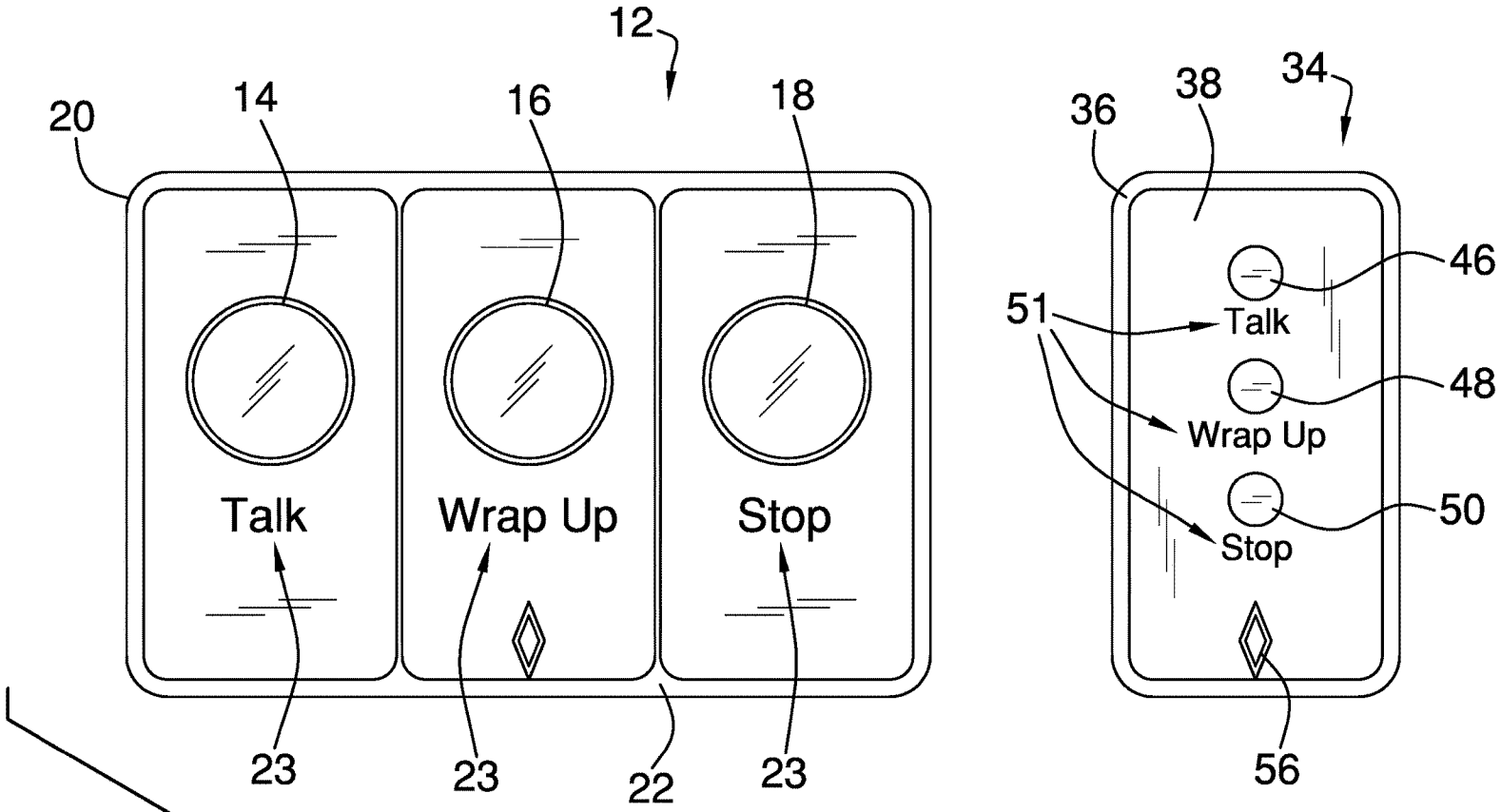
FIG. 2 is a front view of an embodiment of the disclosure.
Figure 3:
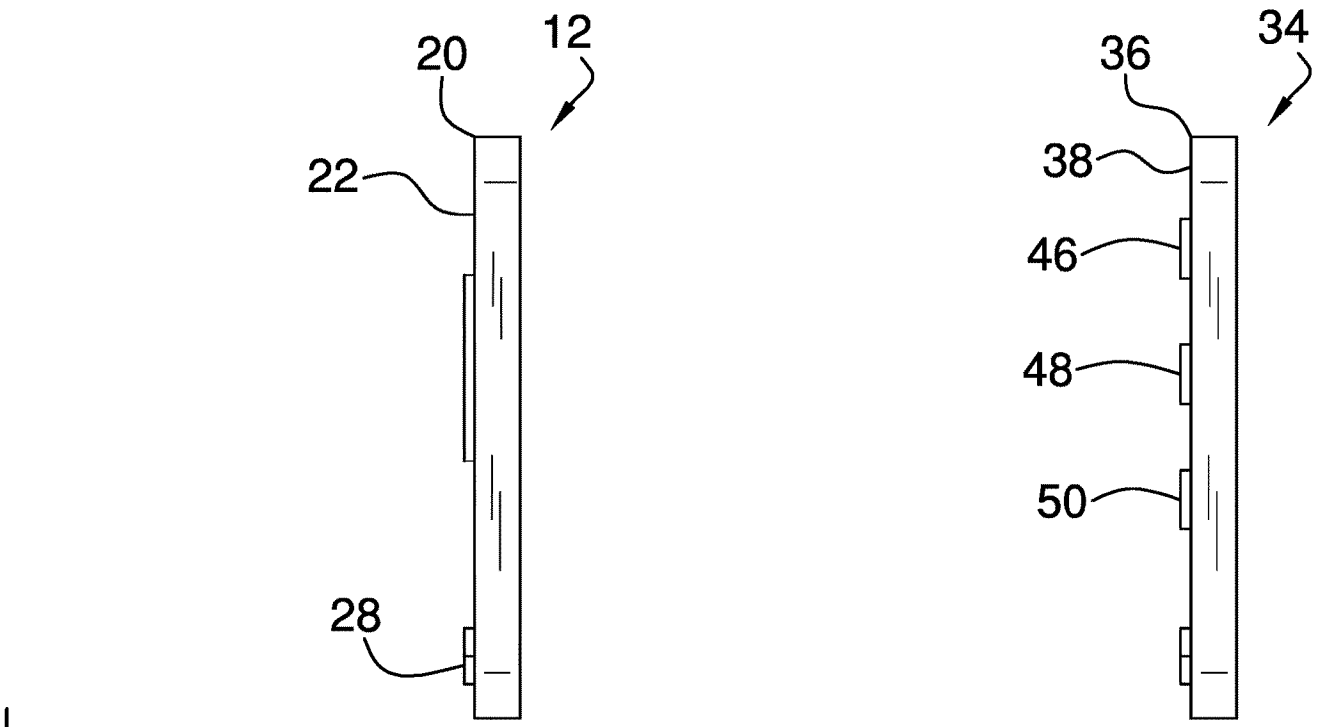
FIG. 3 is a right side view of an embodiment of the disclosure.
Figure 4:
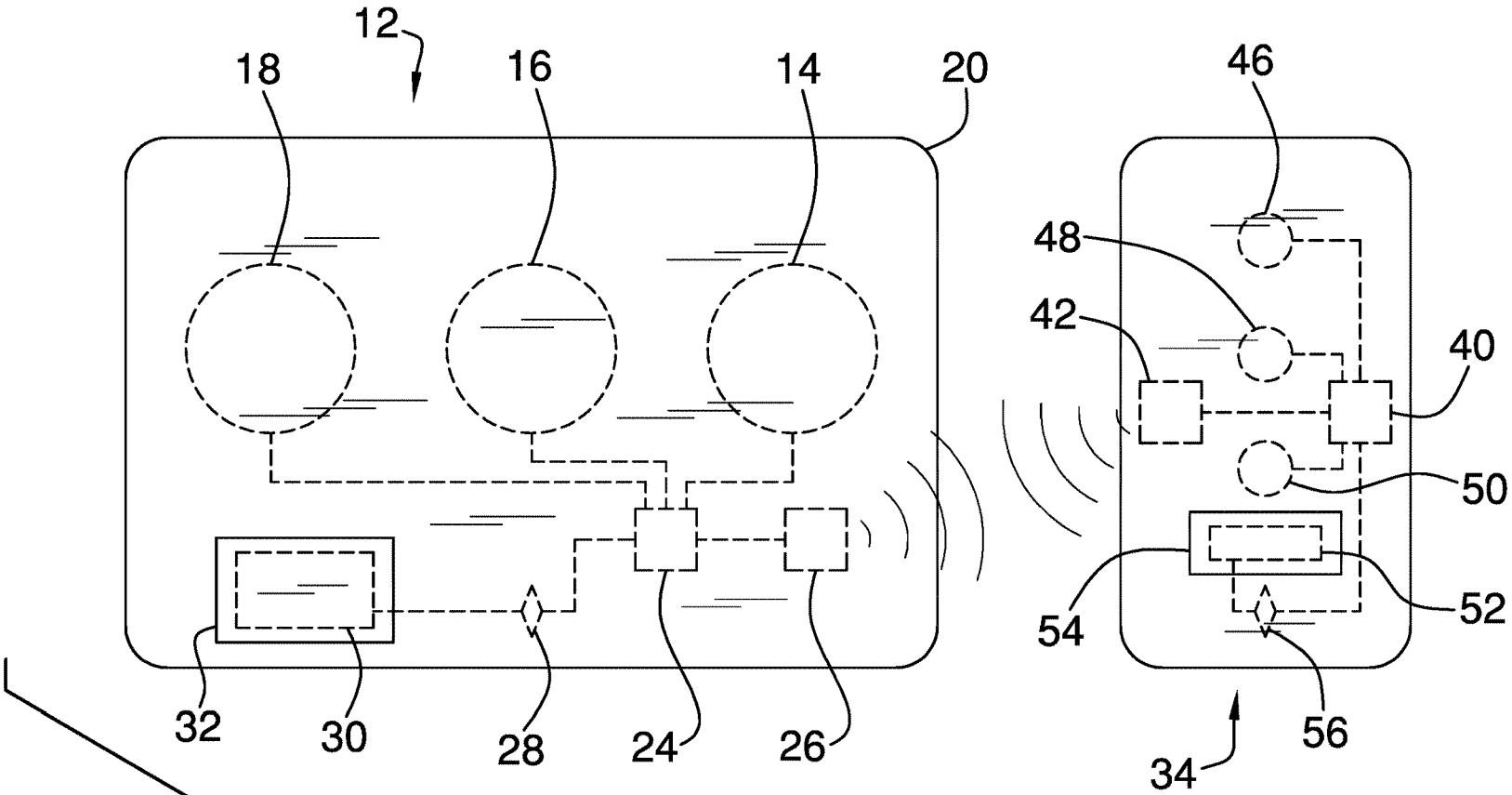
FIG. 4 is a back phantom view of an embodiment of the disclosure.
Figure 5:
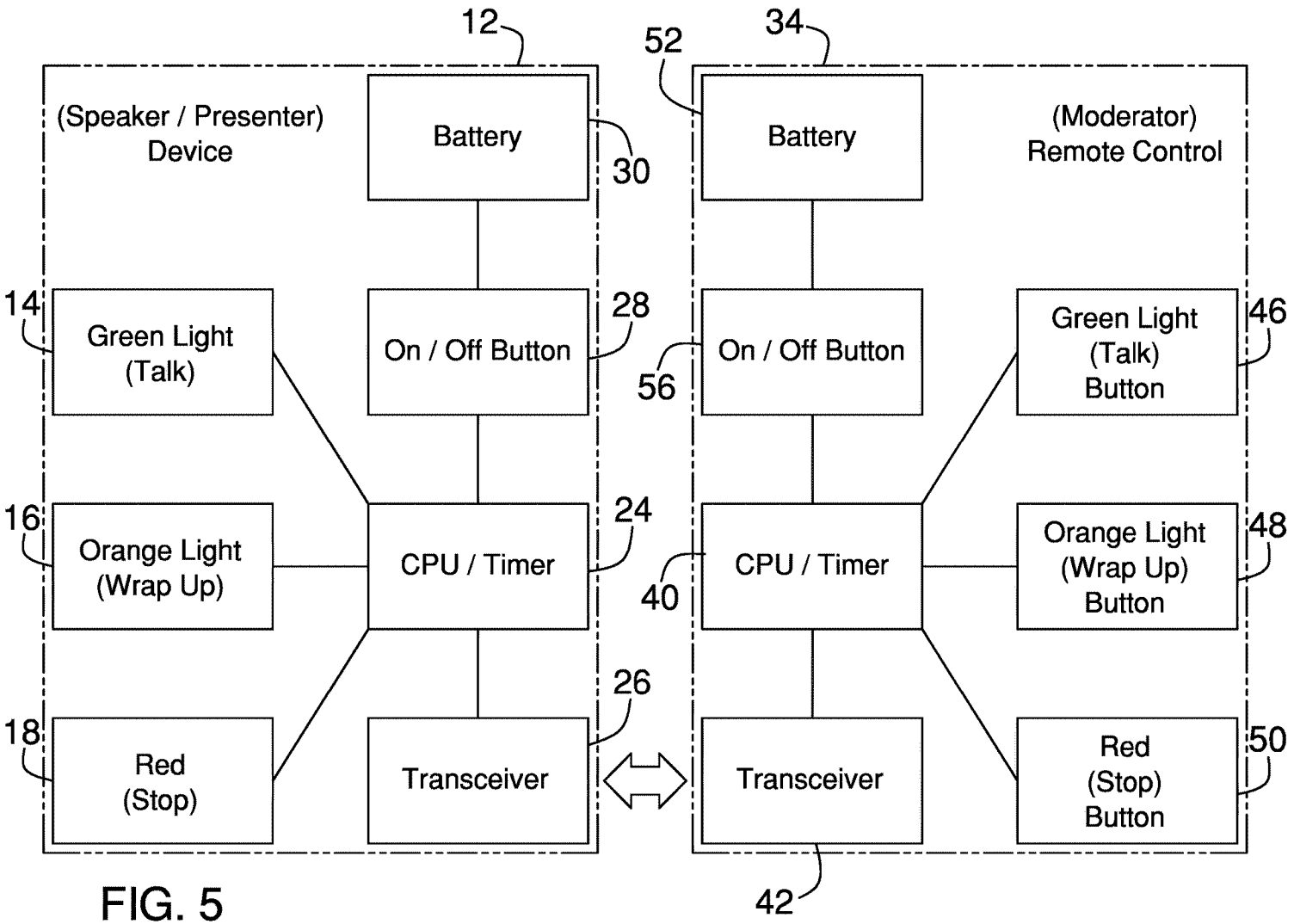
FIG. 5 is a schematic view of an embodiment of the disclosure.

With reference now to the drawings, and in particular to FIGS. 1 through 5 thereof, a new moderator device embodying the principles and concepts of an embodiment of the disclosure and generally designated by the reference numeral 10 will be described.

As best illustrated in FIGS. 1 through 5, the presentation moderator assembly 10 generally comprises a base unit 12 that is positioned in view of a presenter. The presenter may be an individual giving a public speech or otherwise communicating to a mass audience. The base unit 12 has a first light emitter 14 that is selectively illuminated to communicate to the presenter that the presenter may continue speaking. The base unit 12 has a second light emitter 16 that is selectively illuminated to communicate to the presenter that the presenter should begin finishing speaking. Additionally, the base unit 12 has a third light emitter 18 that is selectively illuminated to communicate to the presenter to stop speaking.

The base unit 12 comprises a base housing 20 that has a front wall 22 and each of the first light emitter 14, the second light emitter 16 and the third light emitter 18 is coupled to the front wall 22 of the base housing 20. Moreover, the first light emitter 14, the second light emitter 16 and the third light emitter 18 are spaced apart from each other and are distributed across the front wall 22. The first light emitter 14 may emit green light, the second light emitter 16 may emit yellow light and the third light emitter 18 may emit red light. Additionally, each of the first 14, second 16 and third 18 light emitters may comprise an LED or the like. Indicia 23 may be printed on the front wall 22 of the base housing 20. The indicia 23 may include the words "talk", "wrap up" and "stop" Each of the words may be aligned with an associated one of the first 14, second 16 and third 18 light emitters.

A base processor 24 is positioned within the base housing 20 and the base processor 24 is electrically coupled each of the first light emitter 14, the second light emitter 16 and the third light emitter 18. The base processor 24 selectively generates a talk sequence, a wrap up sequence and a stop sequence. The first light emitter 14 is turned on when the base processor 24 generates the talk sequence, the second light emitter 16 is turned on when the base processor 24 generates the wrap up sequence and the third light emitter 18 is turned on when the base processor 24 generates the stop sequence. The base processor 24 may be an electronic processor or the like. The base processor 24 may include an electronic timer and the electronic timer may turn actuate the base processor 24 to generate the stop sequence after a trigger duration of time has elapsed. The trigger duration of time may be a predetermined duration of time of approximately 2.0 minutes. In this way the presenter knows that a specific amount of time remains once the second light emitter 16 turns on giving the presenter an opportunity to begin finishing the speech.

A base transceiver 26 is positioned within the base housing 20 and the base transceiver 26 is electrically coupled to the processor. The base transceiver 26 may be a radio frequency transceiver or the like. A base power button 28 is movably coupled to the front wall 22 of the base housing 20. The base power button 28 is electrically coupled to the base processor 24 and the base power button 28 turns the base processor 24 on and off.

A base power supply 30 is positioned in the base housing 20 and the base power supply 30 is electrically coupled to the base processor 24. The base power supply 30 comprises at least one battery. A base battery cover 32 is removably coupled to the base housing 20 and the base power supply 30 is positioned beneath the base battery cover 32.

A remote unit 34 is provided and the remote unit 34 is carried by a moderator. The moderator may be an individual that is in charge of determining how long the presenter may speak. The remote unit 34 is in electrical communication with the base unit 12. The remote unit 34 selectively turns on each of the first light emitter 14, the second light emitter 16 and the third light emitter 18. In this way the moderator may communicate in non-verbal and non-physical means how much time remains for the presenter.

The remote unit 34 comprises a remote housing 36 is that is carried by the moderator and the remote housing 36 has a first wall 38. A remote processor 40 is positioned in the remote housing 36. The remote processor 40 selectively generates a start sequence, an alert sequence and a cease sequence. Moreover, the remote processor 40 may be an electronic processor or the like.

A remote transceiver 42 is positioned in the remote housing 36 and the remote transceiver 42 is electrically coupled to the remote processor 40. The remote transceiver 42 is in electrical communication with the base transceiver. The base processor 24 generates the talk sequence when the remote transceiver 42 communicates the start sequence to the first transceiver. The base processor 24 generates the wrap up sequence when the remote transceiver 42 communicates the alert sequence to the base transceiver 26. Additionally, the base processor 24 generates the stop sequence when the remote transceiver 42 communicates the cease sequence to the base transceiver 26. The remote transceiver 42 may be a radio frequency transceiver or the like.

A first button 46 is coupled to the first wall 38 of the remote housing 36 and the first button 46 is electrically coupled to the remote processor 40. The remote processor 40 generates the start sequence when the first button 46 is manipulated. A second button 48 is coupled to the first wall 38 of the remote housing 36 and the second button 48 is electrically coupled to the remote processor 40. The remote processor 40 generates the alert sequence when the second button 48 is manipulated. A third button 50 is coupled the first wall 38 of the remote housing 36 and the third button 50 is electrically coupled to the remote processor 40. The remote processor 40 generates the cease sequence when the third button 50 is manipulated.

Indicia 51 may be printed on the first wall 38 of the remote housing 36. The indicia 51 on the remote housing 36 may include the words "talk", "wrap up" and "stop". Each of the words on the remote housing 36 may be aligned with an associated one of the first 46, second 48 and third 50 buttons.

A remote power supply 52 is positioned in the remote housing 36 and the remote power supply 52 is electrically coupled to the remote processor 40. The remote power supply 52 comprises at least one battery. A remote battery cover 54 is removably coupled to the remote housing 36 and the remote power supply 52 is positioned beneath the remote battery cover 54. A remote power button 56 is coupled to the first wall 38 of the remote housing 36 and the remote power button 56 is electrically coupled to the remote processor 40. The remote power button 56 turns a remote processor 40 on and off.

In use, the base unit 12 is positioned in a location such that each of the first light emitter 14, the second light emitter 16 and the third light emitter 18 are visible to the presenter. The remote unit 34 is carried by the moderator while the presenter is speaking. The moderator depresses the first button 46 on the remote unit 34, causing the first light emitter 14 to illuminate. In this way the presenter knows to begin speaking and that the presenter's allotted time for speaking has begun. The moderator depresses the second button 48 on the remote unit 34, causing the second light emitter 16 to illuminate. In this way the presenter knows that the allotted time for speaking is nearing the end and the presenter needs to begin wrapping up the speech. The moderator depresses the third button 50 on the remote unit 34, causing the third light emitter 18 to illuminate. In this way the presenter knows the allotted time for speaking has elapsed and the presenter needs to end the speech.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A presentation moderator assembly being configured to communicate to a speaker how much time is left for a presentation, said assembly comprising:

a base unit being configured to be positioned in view of a presenter, said base unit having a first light emitter being selectively illuminated wherein said first light emitter is configured to communicate to the presenter that the presenter is begin speaking, said base unit having a second light emitter being selectively illuminated wherein said second light emitter is configured to communicate to the presenter that the presenter should begin finishing speaking, said base unit having a third light emitter being selectively illuminated wherein said third light emitter is configured to communicate to the presenter to stop speaking; and a remote unit being configured to be carried by a moderator, said remote unit being in electrical communication with said base unit, said remote unit selectively turning on each of said first light emitter, said second light emitter and said third light emitter.

2. The assembly according to claim 1, wherein said base unit comprises a base housing having a front wall, each of said first light emitter, said second light emitter, and said third light emitter being coupled to said front wall of said base housing, said first light emitter, said second light emitter and said third light emitter being spaced apart from each other and being distributed across said front wall.

3. The assembly according to claim 2, further comprising:

a base processor being positioned within said base housing, said base processor being electrically coupled each of said first light emitter said second light emitter and said third light emitter, said base processor selectively generating a talk sequence, a wrap up sequence and a stop sequence;

said first light emitter being turned on when said base processor generates said talk sequence;

said second light emitter being turned on when said base processor generates said wrap up sequence; and said third light emitter being turned on when said base processor generates said stop sequence.

4. The assembly according to claim 3, further comprising a base transceiver being positioned within said base housing, said base transceiver being electrically coupled to said processor.

5. The assembly according to claim 3, further comprising a base power button being movably coupled to said front wall of said base housing wherein said base power button is configured to be manipulated, said base power button being electrically coupled to said base processor such that said base power button turns said base processor on and off.

6. The assembly according to claim 3, further comprising a base power supply being positioned in said base housing, said base power supply being electrically coupled to said base processor, said base power supply comprising at least one battery.

7. The assembly according to claim 3, further comprising said remote unit comprises a remote housing being configured to be gripped by the moderator, said remote housing having a first wall.

8. The assembly according to claim 7, further comprising a remote processor being positioned in said remote housing, said remote processor selectively generating a start sequence, an alert sequence and a cease sequence.

9. The assembly according to claim 8, further comprising:

a remote transceiver being positioned in said remote housing, said remote transceiver being electrically coupled to said remote processor, said remote transceiver being in electrical communication with said base transceiver;

said base processor generating said talk sequence when said remote transceiver communicates said start sequence to said base transceiver;

said base processor generating said wrap up sequence when said remote transceiver communicates said alert sequence to said base transceiver; and said base processor generating said stop sequence when said remote transceiver communicates said cease sequence to said base transceiver.

10. The assembly according to claim 9, further comprising a first button being coupled to said first wall of said remote housing wherein said first button is configured to be manipulated, said first button being electrically coupled to said remote processor, said remote processor generating said start sequence when said first button is manipulated.

11. The assembly according to claim 10, further comprising a second button being coupled to said base wall of said remote housing wherein said second button is configured to be manipulated, said second button being electrically coupled to said remote processor, said remote processor generating said alert sequence when said second button is manipulated.

12. The assembly according to claim 11, further comprising a third button being coupled said base wall of said remote housing wherein said third button is configured to be manipulated, said third button being electrically coupled to said remote processor, said remote processor generating said cease sequence when said third button is manipulated.

13. The assembly according to claim 10, further comprising a remote power supply being positioned in said remote housing, said remote power supply being electrically coupled to said remote processor, said remote power supply comprising at least one battery.

14. A presentation moderator assembly being configured to communicate to a speaker how much time is left for a presentation, said assembly comprising:

a base unit being configured to be positioned in view of a presenter, said base unit having a first light emitter being selectively illuminated wherein said first light emitter is configured to communicate to the presenter that the presenter is continue speaking, said base unit having a second light emitter being selectively illuminated wherein said second light emitter is configured to communicate to the presenter that the presenter should begin finishing speaking, said base unit having a third light emitter being selectively illuminated wherein said third light emitter is configured to communicate to the presenter to stop speaking, said base unit comprising:

a base housing having a front wall, each of said first light emitter, said second light emitter, and said third light emitter being coupled to said front wall of said base housing, said first light emitter, said second light emitter and said third light emitter being spaced apart from each other and being distributed across said front wall, a base processor being positioned within said base housing, said base processor being electrically coupled each of said first light emitter said second light emitter and said third light emitter, said base processor selectively generating a talk sequence, a wrap up sequence and a stop sequence, said first light emitter being turned on when said base processor generates said talk sequence, said second light emitter being turned on when said base processor generates said wrap up sequence, said third light emitter being turned on when said base processor generates said stop sequence, a base transceiver being positioned within said base housing, said base transceiver being electrically coupled to said processor, a base power button being movably coupled to said front wall of said base housing wherein said base power button is configured to be manipulated, said base power button being electrically coupled to said base processor such that said base power button turns said base processor on and off, and a base power supply being positioned in said base housing, said base power supply being electrically coupled to said base processor, said base power supply comprising at least one battery; and a remote unit being configured to be carried by a moderator, said remote unit being in electrical communication with said base unit, said remote unit selectively turning on each of said first light emitter, said second light emitter and said third light emitter, said remote unit comprising:

a remote housing being configured to be gripped by the moderator, said remote housing having a base wall, a remote processor being positioned in said remote housing, said remote processor selectively generating a start sequence, an alert sequence and a cease sequence, a remote transceiver being positioned in said remote housing, said remote transceiver being electrically coupled to said remote processor, said remote transceiver being in electrical communication with said base transceiver, said base processor generating said talk sequence when said remote transceiver communicates said start sequence to said base transceiver, said base processor generating said wrap up sequence when said remote transceiver communicates said alert sequence to said base transceiver, said base processor generating said stop sequence when said remote transceiver communicates said cease sequence to said base transceiver, a first being coupled to said base wall of said remote housing wherein said first button is configured to be manipulated, said first button being electrically coupled to said remote processor, said remote processor generating said start sequence when said first button is manipulated, a second button being coupled to said base wall of said remote housing wherein said second button is configured to be manipulated, said second button being electrically coupled to said remote processor, said remote processor generating said alert sequence when said second button is manipulated, the third button being coupled said base wall of said remote housing wherein said third button is configured to be manipulated, said third button being electrically coupled to said remote processor, said remote processor generating said cease sequence when said third button is manipulated, and a remote power supply being positioned in said remote housing, said remote power supply being electrically coupled to said remote processor, said remote power supply comprising at least one battery.

* * * * *